US005588421A

United States Patent [19]

Busch et al.

[11] Patent Number: 5,588,421

[45] Date of Patent: Dec. 31, 1996

[54] HEAT-INSULATING VIEWING WINDOW OR VIEWING DOOR FOR AN APPARATUS HAVING AN INTERIOR TEMPERATURE DEVIATING FROM THE AMBIENT TEMPERATURE THEREOF

[75] Inventors: Dietrich Busch, Simmern; Roland Leroux, Stadacken-Elsheim, both of Germany

[73] Assignee: Schott Glaswerke, Mainz, Germany

[21] Appl. No.: 315,116

[22] Filed: Sep. 29, 1994

[30] Foreign Application Priority Data

Sep. 29, 1993 [DE] Germany ..... 43 33 033.9

[51] Int. Cl.[6] ..... F23M 7/00

[52] U.S. Cl. ..... 126/200; 126/190; 52/204.593

[58] Field of Search ..... 126/190, 193, 126/198, 200; 52/204.6, 204.593; 110/173 R

[56] References Cited

U.S. PATENT DOCUMENTS

| | | | |
|---|---|---|---|
| 2,348,297 | 12/1942 | Huddle | 126/200 |
| 2,536,956 | 1/1951 | Reeves | 126/200 |
| 2,575,655 | 11/1951 | Clerk | 52/204.593 |
| 3,064,320 | 11/1962 | Blaszkowski | 52/204.593 |
| 3,710,776 | 1/1973 | Frick | 126/200 |
| 4,206,338 | 6/1980 | Katona | 126/200 |
| 4,604,840 | 8/1986 | Mondon | 52/204.593 |
| 4,607,468 | 8/1986 | Paquet . | |
| 4,835,926 | 6/1989 | King | 52/204.593 |
| 5,337,727 | 8/1994 | Borens et al. | 126/200 |

FOREIGN PATENT DOCUMENTS

| | | |
|---|---|---|
| 2310084 | 9/1973 | Germany . |
| 2545531 | 4/1977 | Germany . |
| 7706648 | 6/1977 | Germany . |
| 2619718 | 11/1977 | Germany . |
| 2647337 | 4/1978 | Germany . |
| 2726027 | 12/1978 | Germany . |
| 3602455 | 7/1987 | Germany . |
| 4002514 | 8/1990 | Germany . |
| 4206820 | 3/1993 | Germany . |
| 4209622 | 9/1993 | Germany . |

OTHER PUBLICATIONS

"Isolierglas", Baumeister Aug. 1993, p. 54.

*Primary Examiner*—Carl D. Price
*Attorney, Agent, or Firm*—Walter Ottesen

[57] ABSTRACT

A heat-insulating viewing window or door for an apparatus has an inner temperature in a cavity of the apparatus which deviates from the temperature of the ambient in which the apparatus operates. The viewing window is especially for cooking or baking ovens or dryers. The viewing window includes an arrangement of plates positioned at spacings from each other and held in a common frame. The plates can be made of glass, glass ceramic or another transparent temperature-resistant material. At least one further plate is mounted between the plate subjected to the ambient temperature and the plate subjected to the temperature of the interior cavity of the apparatus.

19 Claims, 2 Drawing Sheets

HEAT-INSULATING VIEWING WINDOW OR VIEWING DOOR FOR AN APPARATUS HAVING AN INTERIOR TEMPERATURE DEVIATING FROM THE AMBIENT TEMPERATURE THEREOF

FIELD OF THE INVENTION

The invention relates to a heat-insulating viewing window or viewing door for an apparatus having art interior temperature deviating from its ambient temperature. The viewing window or viewing door is especially for a cooking oven, baking oven or dryer having an arrangement of plates of glass, glass ceramic or another transparent temperature-resistant material. The arrangement is held in a common frame and the plates are positioned at spacings from each other.

BACKGROUND OF THE INVENTION

Viewing windows of this kind are generally known. They are, as a rule, mounted in the front end door of a baking oven or the like. The following description is directed to household cooking ovens. The invention is, however, applicable to any other apparatus that has a viewing window or viewing door which closes off the interior space or cavity wherein the temperature deviates from the ambient temperature of the apparatus. The viewing window or viewing door permits looking into this interior cavity. Accordingly, the viewing window or viewing door is also applicable to freezers and refrigerators or dryers.

In viewing windows for ovens, the inner viewing plate and possible additional viewing plates as well as the front plate are attached to the sheet metal of the door. The viewing plates are inter alia heated by heat conduction because the sheet metal of the door is in direct contact with the cooking cavity and is made of a material (metal) which is a good heat conductor.

In the case of viewing windows, it is, however, in contrast to the remaining walls, which surround a temperature-elevated interior cavity, not possible to provide an effective heat insulation such as with mineral wool and the like. For this reason, it is with precisely such viewing windows that the problem is present that the outer surfaces thereof become too hot.

To reduce the outside temperature of the viewing windows, arrangements are generally used which include multiple plates having an outer plate which does not border directly on the temperature-elevated cavity so that heating of the outside plate by direct heat transfer is avoided. However, even for multiple mutually spaced plates with an intermediate air space, heating of the outside plate by radiation from the temperature-elevated interior cavity occurs. This radiation passes the inner plates, in part, and is directly absorbed by the outer plate and partially also by the inner plates, which, in turn, then transmit heat radiation to the next outer plate or via an air-filled intermediate space to the next outer plate by heat conduction and convection.

Embodiments of viewing windows are already known wherein an outer plate is held forward of the remaining plates at a spacing in such a manner that the frame of the arrangement is open at least at the top and bottom between the outer plate and the next inner plate so that an air convection in the ambient space outside of the apparatus can take place between this outer plate and the next inner plate. On the one hand, the air which becomes heated between the two outer plates is exchanged with the ambient air by circulation and, on the other hand, the outer plate is continuously cooled by this air flow.

German patent publication 7,706,648 discloses a transparent heat-protective unit for cooking ovens, dryers and the like. The heat protective unit has at least two parallelly arranged glass plates and an edge joiner extending completely around the periphery. The edge joiner connects the glass plates to each other and holds the same at a pregiven spacing from each other. The edge connector has a spacer section which is placed between the peripheries of the plates and each glass plate is cemented by means of a sealing mass to each other and to this spacer profile. The sealing mass remains elastic even under the influence of heat.

It is an object of the invention of German patent publication 7,706,648 to provide a heat-protective unit wherein the thermal insulation is improved and to prevent the inner side thereof from becoming vapor coated and dirtied.

German patent publication 3,602,455 discloses a cooking oven for baking, roasting, grilling and the like and having a cooking cavity with at least one heating element and a door closing off the cooking cavity. The heating element is provided on the upper side of the cooking cavity and the door comprises two parallel door shells mounted at a spacing from each other. Each of the door shells has a glass plate and the two door shells are connected to each other by rails arranged therebetween. The rails each have parallel legs which run spaced from each other. The rails have U-shaped or Z-shaped cross sections and the outer legs thereof are cemented to the outer door shell.

German patent publication 3,602,455 discloses a cooking oven which is so configured that the outer door shell has no regions at which dirt can collect and an excessive heat-up of the outer door shell is avoided.

It is also possible to utilize thermochrome plates in the interior having radiation penetrability which is reduced with a temperature increase. This, however, affects viewing through the window.

It is also known to provide one or more plates of a multi-plate arrangement with a coating which either reflects infrared radiation or reduces the emission of infrared radiation. A coating having both these characteristics is, for example, a coating of fluorine-doped tin dioxide. If the coating is applied to the inner side of a plate facing toward the temperature-elevated cavity, then the coating reflects a portion of the infrared radiation back into the interior cavity. If the coating is applied to the outer side of a plate, then the coating reduces the infrared radiation in the outward direction to the next outer plate. The plates can also be coated on both sides.

German patent publication 4,206,820 discloses a cooking oven door for a cooking oven having a viewing window of which at least one glass plate has a heat-radiation reflecting coating. The reflecting coating is applied to the surface of the glass plate facing away from the interior oven cavity.

It is also an object of this invention to effect a reduction of the temperature at the front side of the cooking oven.

Notwithstanding the above-mentioned measures, it occurs frequently that, in household cooking ovens, the temperature of the outer plate of a viewing window rises up to 150° C. and higher. This temperature rise occurs especially in household cooking ovens which are operated at temperatures of 450° C. to 500° C. and more, especially during self-cleaning utilizing pyrolysis. To make the viewing window safe with respect to contact therewith by an operator, it is a goal to limit the permissible outside temperature of such viewing windows to 78° C. which is consistent with common standards (see, for example, UL 858, Underwriter Laboratory Household Domestic Appliances).

Furthermore, up to now, each plate is individually fastened during the assembly of the viewing plates by the oven manufacturer. This practice is associated with high cost with respect to both materials and time.

SUMMARY OF THE INVENTION

It is an object of the invention to suggest measures with which a further increase of the difference between the temperature of the interior cavity during operation of the particular apparatus and its ambient temperature is possible. The apparatus can, for example, be a household cooking oven or a refrigerator or freezer. It is another object of the invention to reduce the consumption of energy with these measures.

This means especially with cooking ovens, to reduce the outside temperature of the viewing window to values which present no danger whatsoever for persons which operate the apparatus and also for children and house pets which can come into inadvertent contact with the viewing window. The energy consumption should be approximately 5% to 20% less than for a conventional apparatus.

It is another object of the invention to have prefabricated viewing window units available which reduce the complexity of assembly during manufacture.

These objects of the invention are solved in that a further plate is provided between the plate subjected to the ambient temperature and the plate subjected to the temperature of the interior cavity of the apparatus.

All plates can be mounted parallel to each other or at least two plates can be mounted so that they conjointly define an acute angle in the range between 0.5° and 10°.

The plates conjointly defining an angle of inclination with respect to each other are so mounted that the inclination of the plates with respect to each other extends vertically. Depending upon the application, the plates can converge in the upper direction or they can diverge in the upper direction.

The temperature-reducing effect of the inclined position takes place, depending upon the particular embodiment of the viewing window, apparently because of a specific radiation path and possibly because of improved convection.

Between parallel plates, a back-and-forth radiation of heat runs generally perpendicularly to the surface of the plates. In contrast to these parallel plates, it appears that a back-and-forth radiation occurs between the two mutually inclined plates which advances between the plates toward the diverging region pursuant to the reflection law until the radiation is absorbed at the diverging end of the plates by the frame of the plate arrangement. The heat dissipation in the viewing window frame is controllable. With respect to the invention, it is essential that the temperature at the outer surface at the outer plate of a multi-plate arrangement is reduced. The plates of the viewing window can be made with different compositions of material.

The plate subjected to the temperature of the interior cavity of the apparatus typically comprises, for example, a pretensioned, heat-reflecting coated lime-natron-float glass which is commercially available from Schott Glaswerke under the trademark THERMAX 5000®. The additional intermediately disposed plate and the plate subjected to the ambient temperature are made of a pretensioned lime-natron-float glass such as is available from Schott Glaswerke under the trademark DURAX®. According to a feature of the invention, the additional intermediately-lying plate is connected at its periphery with the plate subjected to the ambient temperature. The spacing of the additional intermediately-lying plate from the plate subjected to the ambient temperature is fixed especially between 5 mm and 20 mm by means of a spacer. The spacers comprise material which is heat insulating and this material can be, for example, ceramic, glass, plastic or silicone.

This affords the advantage that the paths of the heat conduction from the sheet metal of the door to the intermediately-lying plate is lengthened and thereby reduces its temperature.

In an especially advantageous embodiment, the spacer is compressible and configured as a silicone hose or tubing.

The use of a compressible silicone tubing, which can be collapsed, makes it possible without difficulty to provide the necessary pressure compensation when the cooking oven is heated. The compressible volume of the silicone tubing is then adapted to the particular different temperature differences and air volumes which occur between the plates.

According to another feature of the invention, a temperature-resistant adhesive such as a silicone adhesive is used in order to join the intermediately-lying plate, the spacer and the plate subjected to the ambient temperature.

The application of the silicon adhesive also simplifies recycling the viewing window composite when the latter has been used and must be disposed off because only the two materials of glass and silicone are present.

In the preferred embodiment, a closed space and therefore an insulating viewing window is provided by a gas-tight adhesion of the spacers to the intermediately-lying plate and the plate subjected to the ambient temperature.

The gas-tight enclosed space between the plates can be filled with a poor heat-conducting gas such as argon, krypton or carbon dioxide.

The gas-tight closed space must be provided with means for compensating for pressure when temperature changes occur when the layering of the plates is not achieved via a collapsible silicon tubing as described above. This can be achieved with simple, well known means.

It can also be advantageous to provide at least one of the plates with a heat-reflecting coating such as tin dioxide. This coating can be placed only on one side or on both sides of the one plate.

According to another feature of the invention, the intermediately-lying plate of the heat-insulating viewing window is the same size or greater than the plate subjected to the temperature of the interior cavity of the apparatus and less than the plate subjected to the ambient temperature.

This is advantageous because a maximum heat insulation is achieved with a relatively simple construction and with little consumption of material.

In a further embodiment of the invention, a still further plate is provided between the intermediately-lying additional plate and the plate subjected to the temperature of the inner cavity of the apparatus. This second additional plate is mounted by means of adhesive.

This measure then provides an especially pronounced heat-insulating effect.

According to the invention, the viewing window is pre-assembled as a prefabricated unit for assembly into an apparatus wherein the temperature of the interior space deviates from the ambient temperature.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
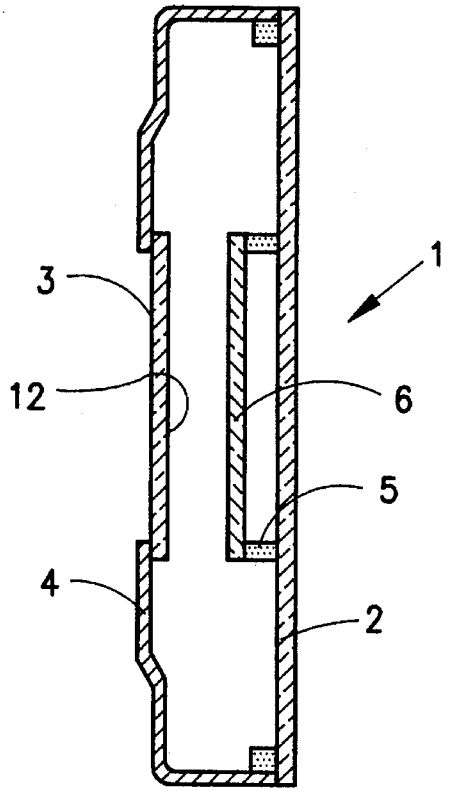
FIG. 1 is a schematic section view of a heat-insulating viewing window according to a first embodiment of the invention.

Referring to FIG. 1, the heat-insulating viewing window 1 shown in FIG. 1 includes a front plate 2 and a plate 3 subjected to the temperature of the interior cavity of the oven. The viewing window is mounted in the front door made of sheet metal 4. The embodiment of FIG. 1 includes a plate 6 arranged between the front plate 2 and the plate 3. The intermediately-lying plate 6 is mounted on the front plate 2 by spacer means 5.

Figure 2:
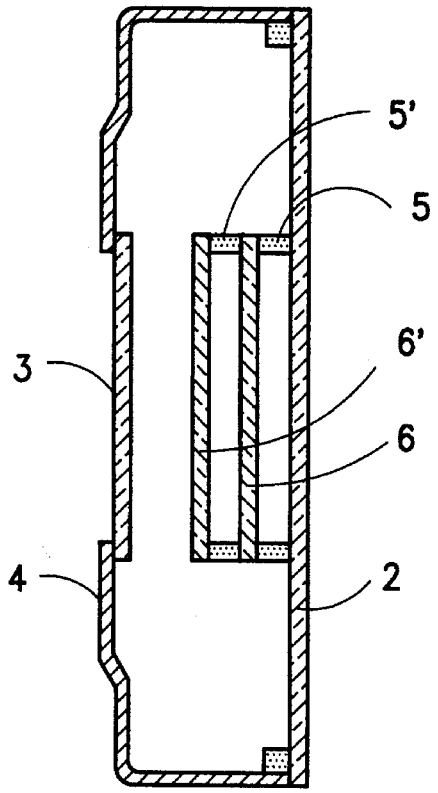
FIG. 2 is a section view of another embodiment of the viewing window according to the invention wherein two intermediately-lying plates are mounted with spacers on the front plate of the window.

FIG. 2 is an embodiment similar to that shown in FIG. 1 except that here two intermediately-lying plates (6, 6') are shown. These plates (6, 6') are connected to each other via a first spacer 5' and to the front plate 2 via a second spacer 5.

Figure 3A:
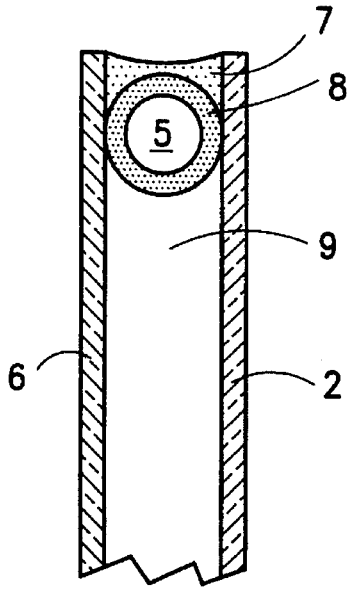
FIG. 3*a* shows another embodiment of the invention corresponding to that of FIG. 1 wherein a pressure-compensating silicone tube is provided as a spacer between the intermediately-lying plate and the front plate.

FIG. 3*a* is a detail view showing a portion of the viewing window of FIG. 1. An intermediate space 9 is formed by the plate 2 subjected to the ambient temperature and an intermediately-lying plate 6. The intermediate space 9 is formed gas tight by means of a silicone adhesive 7 and a collapsible silicone tube 8 which operates as a spacer 5. FIG. 3*a* shows the collapsible silicone tube for the condition wherein the temperature of the interior cavity and the ambient temperature are approximately the same.

Figure 3B:
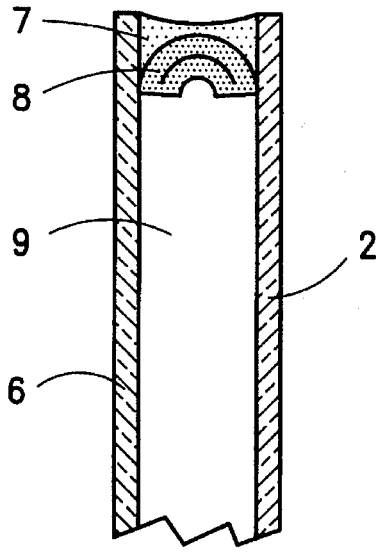
FIG. 3*b* corresponds to the embodiment of FIG. 3*a* wherein the silicone tube has collapsed to compensate for increased pressure within the space between the intermediately-lying plate and the front plate.

In contrast, FIG. 3*b* shows the detail of FIG. 3*a* for the condition wherein the silicone tube has collapsed in response to the expansion of heated gases in the intermediate space 9 thereby compensating for the pressure increase which occurs when the temperature of the inner cavity of the oven is greater than the ambient temperature.

Figure 4:
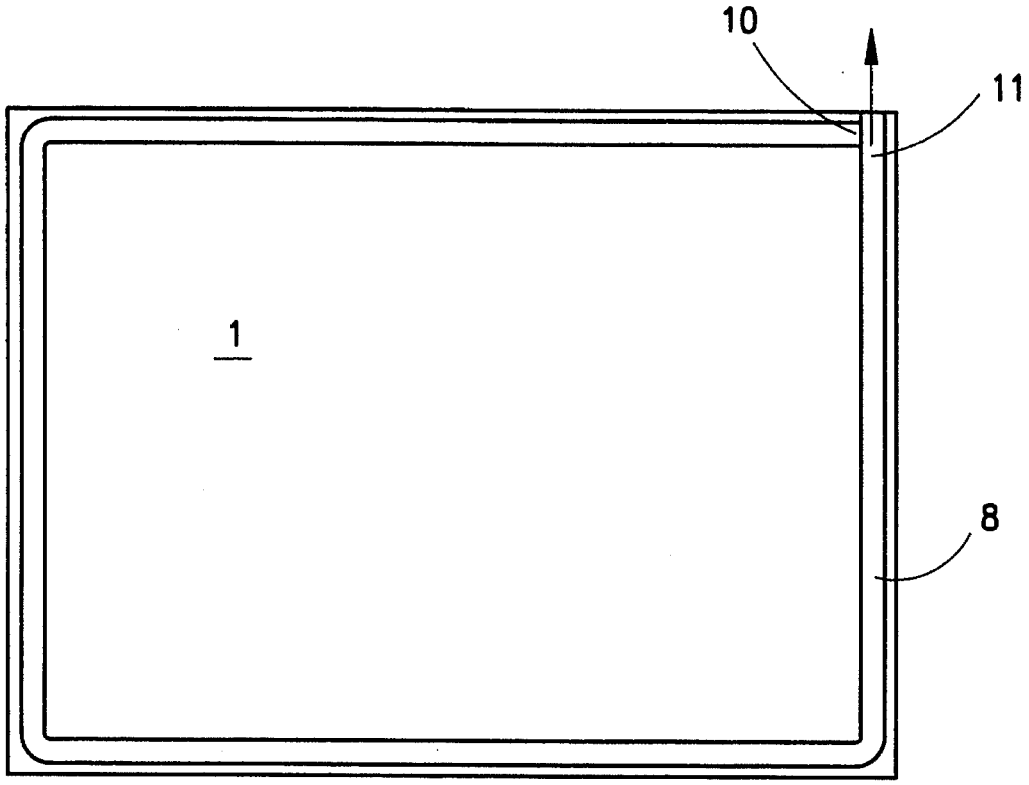
FIG. 4 shows a schematic front view of a viewing window according to the invention wherein a compressible silicone tube vents when it collapses to compensate for pressure; and, FIG. 5 shows still another embodiment of the invention wherein the intermediate-lying plate is positioned at an angle with respect to the front plate.

FIG. 4 shows the front plate 2 of a viewing window 1 equipped with a collapsible silicone tube 8. The silicone tube 8 is closed at one end 10 and open to the ambient at the other end 11 in order to provide pressure compensation.

Figure 5:
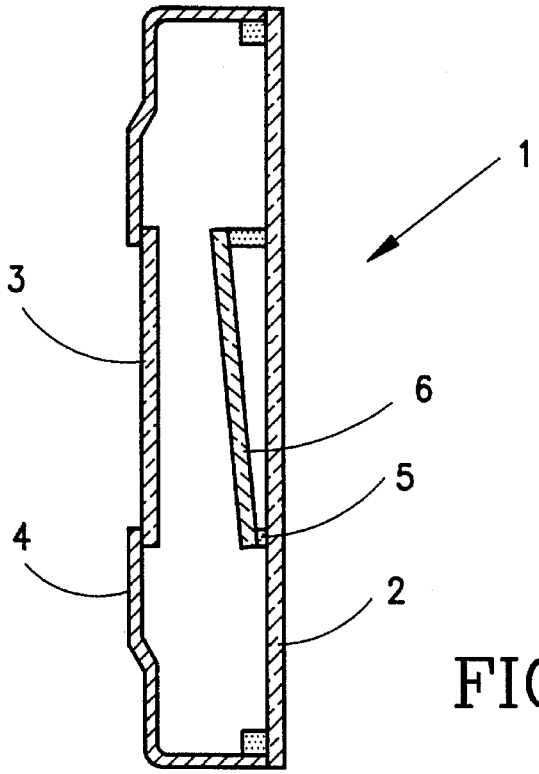

In FIG. 5, the intermediately-lying plate 6 and the front plate 2 conjointly define an acute angle. The acute angle can be between 0.5° and 10°.

In the following, two examples are given for which actual measured data has been obtained.

EXAMPLE 1

A conventional household cooking oven is used. The oven door is made up of three viewing plates (inner plate, middle plate and front plate). The spacing between the inner plate and the outer plate is 22 mm. The plate size of the inner and the middle plates is approximately 400×300 $mm^2$. The inner plate is made of a pretensioned, heat-reflectingly coated lime-natron-float glass which is commercially available under the trademark THERMAX 5000®. The heat-reflecting coating 12 of this plate is disposed to face away from the oven cavity. The middle plate and the front plate are made of a pretensioned lime-natron-float glass available commercially under the trademark DURAX®. The middle and inner plates are arranged as shown in FIG. 1. The middle plate is attached to the front plate with a hose-shaped peripherally-extending spacer and with the aid of a temperature-resistant silicone adhesive (see FIGS. 3*a* and 3*b*).

A temperature of 200° C. is adjusted in the cooking oven by means of a controller. At this temperature, a temperature at the surface of the front plate of 65° C. results wherein the middle viewing plate is attached to the sheet metal of the door. With the embodiment shown in FIG. 1, a temperature at the surface of the front plate of 60° C. results.

EXAMPLE 2

For this example, a commercially available household cooking oven is used which is also equipped with means for pyrolytically self-cleaning the oven. The door of the cooking oven has four plates (inner plate, two middle plates and a front plate). The inner and middle plates have the size of approximately 300×400 mm. The inner plate and the next middle plate viewed from the cooking cavity are provided with a heat-reflecting coating on the mutually adjacent surfaces of these two plates. The second middle plate viewed from the cooking cavity and the front plate are made of DURAX® glass. The front plate is an arcuate plate. The plates are mounted as shown in FIG. 2. The two middle plates are attached to the curved front plate by means of a hose-shaped peripherally-extending spacer and with the aid of temperature-resistant silicone adhesive. The entire plate package has a thickness of approximately 50 mm.

The oven cavity temperature is set at 200° C. utilizing a controller. At this temperature of 200° C., a front plate surface temperature of 63° C. results in a conventional assembly wherein the inner and center plates are mounted on the sheet metal of the door. However, for an assembly of the middle plates as shown in FIG. 2, the temperature at the surface of the front plate is 45° C.

During pyrolyric self cleaning, the temperature of the cooking oven is in the range of 480° C. to 500° C. Under this condition, a surface temperature of 150° C. is obtained for the conventional apparatus whereas a temperature of 110° C. is obtained when the viewing window is configured according to the invention as shown in FIG. 2.

It is understood that the foregoing description is that of the preferred embodiments of the invention and that various modifications may be made thereto without departing from the scope of the invention as defined in the appended claims.

What is claimed is:

1. A heat-insulating window in a door for an apparatus operable in an ambient atmosphere having a first temperature, the apparatus having an interior cavity at a second temperature deviating from said first temperature, said window in a door comprising:

a first plate having a side in contact with the ambient atmosphere;

a second plate having aside facing toward said interior cavity;

a frame common to said first and second viewing plates for holding said plates in spaced relationship to each other so that said plates define an intermediate space therebetween;

a third plate disposed in said intermediate space;

mounting means for mounting and holding said third plate in position between said first and second plates;

said third plate having a peripheral edge;

said mounting means being an elongated spacing member extending along said peripheral edge and joining said third plate to said first plate;

said elongated spacing member being a compressible tube;

said tube having an annular cross section and being defined by a wall having a substantially uniform thickness;

said first and third plates and said compressible tube conjointly defining an enclosure containing a gas which expands to increase pressure in said enclosure in response to a change of said second temperature relative to said first temperature;

a temperature-resistant adhesive for joining said compressible tube, said first plate and said third plate to each other; and, said tube having an opening formed therein allowing gas in said tube to escape whereby said tube collapses to compensate for the increase in pressure of said gas contained in said enclosure.

2. The heat-insulating window of claim 1, said plates being made of a transparent material including glass and glass ceramic.

3. The heat-insulating window of claim 1, said plates being all parallel to each other.

4. The heat-insulating window of claim 1, at least two of said plates conjointly defining an acute angle.

5. The heat-insulating window of claim 4, said acute angle being in a range between 0.5° and 10°.

6. The heat-insulating window of claim 1, said plates having different material compositions.

7. The heat-insulating window of claim 1, said elongated spacing member being configured to position and hold said third plate at a distance from said first plate in the range of 5 mm to 20 mm.

8. The heat-insulating window of claim 7, said elongated spacing member being made of a heat-insulating material.

9. The heat-insulating window of claim 8, said heat-insulating material being a material selected from the group consisting of ceramic, glass, plastic and silicone.

10. The heat-insulating window of claim 1, said temperature-resistant adhesive being a silicone adhesive.

11. The heat-insulating window of claim 11, claim 1, said adhesive being a gas-tight adhesive thereby making said enclosure a gas-tight enclosure.

12. The heat-insulating window of claim 11, said gas-tight enclosure being filled with a gas.

13. The heat-insulating window of claim 12, said gas being selected from the group consisting of argon, krypton and carbon dioxide.

14. The heat-insulating window of claim 1, at least one of said plates being coated with a heat-reflecting substance.

15. The heat-insulating window of claim 14, said heat-reflecting substance being tin dioxide doped with fluorine.

16. The heat-insulating window of claim 1, said third plate being at least as large as said second plate.

17. The heat-insulating window of claim 1, said third plate being smaller than said first plate.

18. The heat-insulating window of claim 1, further comprising a fourth plate disposed between said second plate and said third plate; and, said mounting means comprising adhesive means for mounting and holding said fourth plate between said second plate and said third plate.

19. The heat-insulating window of claim 1, said annular cross section of said tube being a circular cross section.

* * * * *

UNITED STATES PATENT AND TRADEMARK OFFICE

CERTIFICATE OF CORRECTION

PATENT NO. : 5,588,421

DATED : December 31, 1996

INVENTOR(S) : Dietrich Busch and Roland Leroux

It is certified that error appears in the above-indentified patent and that said Letters Patent is hereby corrected as shown below:

In column 1, line 10: delete "art" and substitute -- an -- therefor.

In column 6, line 52: delete "pyrolyric" and substitute -- pyrolytic -- therefor.

In column 7, line 3: delete "aside" and substitute -- a side -- therefor.

In column 8, line 17: delete "claim 11,".

Signed and Sealed this

Twenty-fifth Day of March, 1997

*Attest:*

Bruce Lehman

BRUCE LEHMAN

*Attesting Officer*

*Commissioner of Patents and Trademarks*